US008136665B2

(12) United States Patent
Van Marle et al.

(10) Patent No.: US 8,136,665 B2
(45) **Date of Patent: *Mar. 20, 2012**

(54) PACKAGE FOR CANDY BARS AND HOLDER THEREFOR

(75) Inventors: Niels Van Marle, Noord-Brabant (NL); Ronald Lewerisa, Noord-Brabant (NL)

(73) Assignee: Mars, Incorporated, McLean, VA (US)

( * ) Notice: Subject to any disclaimer, the term of this patent is extended or adjusted under 35 U.S.C. 154(b) by 1623 days.

This patent is subject to a terminal disclaimer.

(21) Appl. No.: 10/545,067

(22) PCT Filed: Feb. 10, 2004

(86) PCT No.: PCT/EP2004/050109

§ 371 (c)(1),
(2), (4) Date: Aug. 7, 2006

(87) PCT Pub. No.: WO2004/071894

PCT Pub. Date: Aug. 26, 2004

(65) Prior Publication Data

US 2009/0008289 A1 Jan. 8, 2009

(30) Foreign Application Priority Data

Feb. 12, 2003 (EP) ..... 03100304

(51) Int. Cl.

| | |
|---|---|
| ***B65D 73/00*** | (2006.01) |
| ***B65D 75/58*** | (2006.01) |
| ***B65D 5/52*** | (2006.01) |
| ***B65D 77/02*** | (2006.01) |

(52) U.S. Cl. ..... 206/495; 206/739; 206/748; 206/749; 206/760; 426/108; 426/115

(58) Field of Classification Search ..... 206/739, 206/743, 745–750, 759, 760, 495, 526, 478, 206/480, 482; 229/87.01–87.15; 426/108–120
See application file for complete search history.

(56) References Cited

U.S. PATENT DOCUMENTS

| | | | | | |
|---|---|---|---|---|---|
| 1,448,435 | A | * | 3/1923 | Davis | 206/748 |
| 1,477,241 | A | * | 12/1923 | Carson | 206/482 |
| 1,719,681 | A | | 7/1929 | Wiebusch | |
| 1,866,323 | A | | 7/1932 | Russell | |
| 1,879,952 | A | * | 9/1932 | Rosen | 206/482 |
| 1,929,615 | A | * | 10/1933 | Tanner | 206/743 |
| 1,930,311 | A | * | 10/1933 | Gittleman | 206/482 |
| 2,178,067 | A | * | 10/1939 | Cohen | 206/482 |
| 2,198,138 | A | | 4/1940 | Sutton | |
| 2,560,520 | A | * | 7/1951 | Berkson | 206/346 |
| 4,070,489 | A | * | 1/1978 | Pahnke | 426/115 |
| 4,109,826 | A | * | 8/1978 | Maisonneuve | 426/115 |
| 4,666,079 | A | * | 5/1987 | Bolli et al. | 229/87.05 |
| 5,188,223 | A | * | 2/1993 | Brose et al. | 206/760 |

FOREIGN PATENT DOCUMENTS

EP 1 598 670 9/1981

(Continued)

*Primary Examiner* — Bryon Gehman
(74) *Attorney, Agent, or Firm* — Fitzpatrick, Cella, Harper & Scinto

(57) ABSTRACT

The invention discloses a system comprising at least one package for one or more candy bars or other similar products, and a holder for said package comprising at least one flap for engaging the package in a holding position. A holder comprising a flat surface, at least one flap for engaging a packaged product in a holding position, and at least one flap for supporting a tubular envelope of the packaged product in the holding position, and a method for holding together for transport, storage and/or displaying at a retail outlet are also disclosed.

13 Claims, 2 Drawing Sheets

FOREIGN PATENT DOCUMENTS

| | | |
|---|---|---|
| EP | 1 022 233 | 7/2000 |
| EP | 1 262 425 | 12/2002 |

* cited by examiner

PACKAGE FOR CANDY BARS AND HOLDER THEREFOR

The invention relates to a system comprising at least one package for one or more candy bars or other (similar) products, which package is made of a substantially rectangular foil sheet, a first part of which, near a first cathetus (rectangular side) thereof, is adhered to a second part, near a second cathetus (rectangular side) positioned opposite said first cathetus, thus forming a tubular envelope comprising a longitudinal seal positioned outside said tubular envelope, which tubular envelope is closed at both ends; and a holder for said package, said holder comprising engaging means for engaging the package in its holding position.

The invention particularly refers to such a holder with which packaged candy bars or similar snack products, can be transported, stored and displayed in a shop.

It is noted that the present invention is not restricted to candy bars as packaged products, but extends to any other packaged product, such as petfood, M&M's®, etcetera.

It has been usual heretofore to pack such packaged products, such as the known Mars® or Snickers® bars which are packed in a tubular foil envelope, in cardboard display boxes, wherein a plurality of display boxes are then packed into a transport box for transport and storage. In this manner the product is packed in three packing layers, i.e. the product packaging, the display box and the transport box. It will be apparent that such a method of packaging requires much packaging material, which is undesirable from cost and environmental considerations. Such a method of packaging is moreover relatively labour-intensive during both packing and unpacking.

The invention has for its object a system for transport, storage and sale of such packaged products which is less expensive, wherein less packing material is necessary, and/or which is less labour-intensive.

In order to accomplish that objective, a system of the kind referred to in the introduction according to the invention is characterized in that said engaging means in the holding position extend between said tubular envelope and said longitudinal seal. As said longitudinal seal is present outside the tubular envelope, whose ends are closed (for example by means of a transversal seal), a "pocket" is formed, being particularly suited for receiving said engaging means in order to firmly engage the package. The engaging means preferably comprise at least one flap extending outwardly relative to the holder. A significant advantage of such holders is that when they are used both the display boxes and the transport boxes are unnecessary, because the holders with the products are suitable for stacking in for instance containers during transport and storage. Each holder is particularly provided with a plurality of engaging means in the form of outwardly extending flaps, so that a plurality of candy bars or similar products can be engaged in their holding position. From a commercial (esthetic) point of view each candy bar is preferably engaged in a horizontal holding position.

In one preferred embodiment of a system in accordance with the invention the holder comprises supporting means for supporting said tubular envelope in the holding position, wherein the supporting means comprise at least one flap extending outwardly relative to the holder. In case a holder holds a plurality of candy bars, each candy bar is supported by an adjacent (underlying) candy bar, except for the lowest (underlying) candy bar. For the latter candy bar and in case the holder holds only one candy bar, additional supporting means as mentioned above may be necessary.

In a further preferred embodiment of a system according to the invention the flap of the engaging means in the holding position extends at least substantially parallel to the holder, wherein the flap of the supporting means in the holding position extends at least substantially perpendicular to the holder.

In a further preferred embodiment of a system in accordance with the invention the flap(s) is/are made of a flexible material. Preferably, the flap(s) is/are made of an elastic material, so that the flap(s) is/are capable of recovering orientation and shape after deformation. Particularly, the flap(s) can be hinged about a hinge axis, for example a weakening line particularly in the form of a folding line or a perforation line present in the holder.

In a further preferred embodiment of a system according to the invention the flap(s) is/are in one piece with the holder. The holder is preferably made of a plate-like material, such as cardboard, paper or a plate-like synthetic material etcetera.

The invention is also related to a holder to be used in a system in accordance with the invention.

The invention also refers to a method for holding together for transport, storage and/or displaying at a retail outlet at least one package for one or more candy bars or other (similar products), said package being made of a substantially rectangular foil sheet, a first part of which, near a first cathetus thereof, is adhered to a second part, near a second cathetus positioned opposite said first cathetus, thus forming a tubular envelope comprising a longitudinal seal positioned outside said tubular envelope, which tubular envelope is closed at both ends;

using a holder for said package, said holder comprising engaging means for engaging the package in a holding position;

characterized in that the package is engaged in the holding position by said engaging means extending between said tubular envelope and said longitudinal seal. The engaging means are particularly formed by at least one flap extending outwardly relative to the holder.

The invention will now be further elucidated with reference to an embodiment shown in the figures, wherein FIG. 1 is a perspective view of a packaged candy bar;

Figure 1:
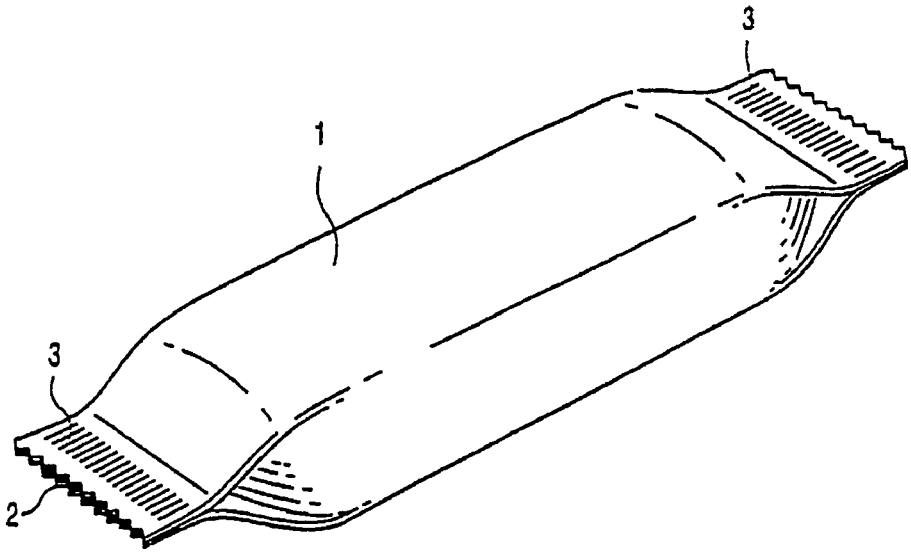

FIG. 1 is a perspective view of a package which contains one or more candy bars. The package consists of a foil sheet 1, which comprises a longitudinal seal 2, only the end of which is visible in FIG. 1. Said longitudinal seal forms a tubular envelope, whose ends are closed by means of a seal 3.

Figure 2:
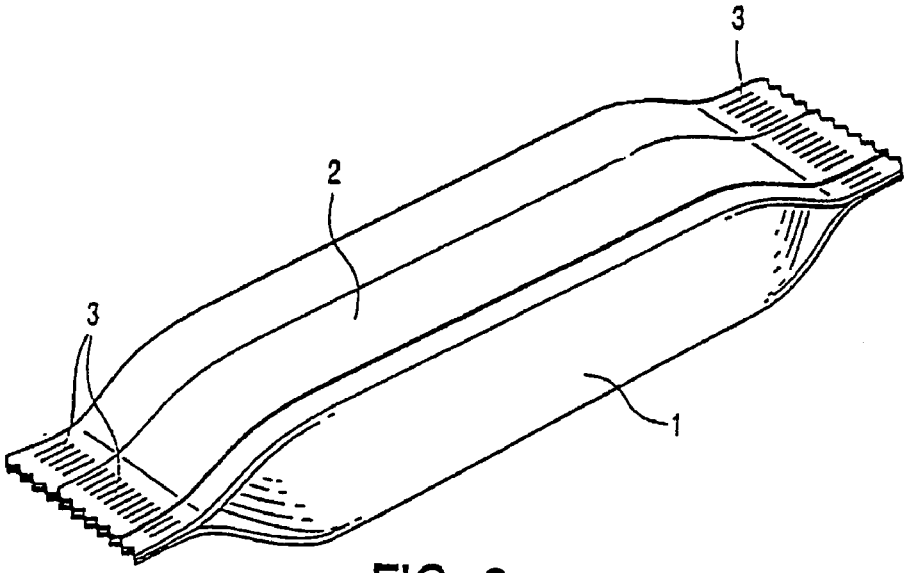
FIG. 2 shows the same package in another position.

The longitudinal seal 2 is present outside the tubular envelope and butts flat against the package, as is shown in FIG. 2.

Figure 3:
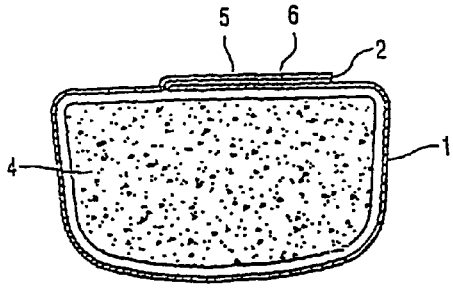
FIG. 3 is a cross-sectional view of a packaged candy bar.

FIG. 3 is a cross-sectional view of a candy bar 4, which is packaged in the foil 1 as shown in FIG. 2. As shown in FIG. 3, two parts 5,6 of the foil 1 (first part 5 and second part 6) are adhered together by means of an adhesive, so that parts 5,6 together form the longitudinal seal 2, which butts flat against the package of the candy bar 4. The second part 6 thereby butts against the outer side of said tubular envelope.

Figure 4:
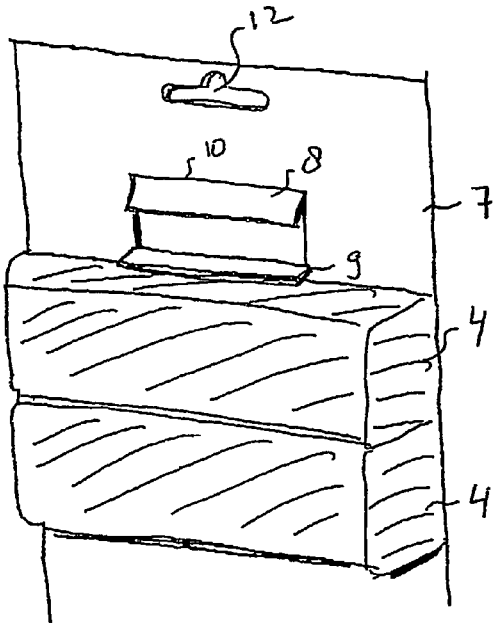
FIG. 4 shows a perspective view of a holder according to the invention, while holding two candy bars of FIGS. 1, 2 and 3 (FIG. 4)
Figure 5:
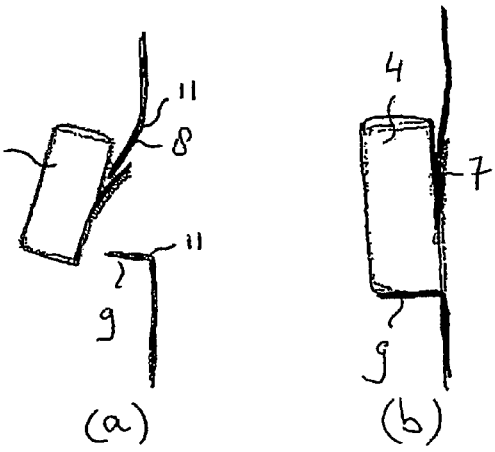
FIG. 5 is a schematic cross-sectional view of the holder of FIG. 4 with only one candy bar.

In FIG. 4 is shown a flat holder 7 made of cardboard, wherein a plurality of rectangular flaps or panels are cut out. Each pair of flaps 8,9 serves to hold a packaged candy bar 4 in its horizontal holding position. Both flaps 8,9 are able to hinge about a hinge axis formed by a folding line 10,11 made in the holder 7. In order to hold the candy bar onto the holder 7 the flap 8, extending outwards relative to the holder 7, has to engage the package between the tubular envelope and the longitudinal seal 2 (FIG. 5*a*). The flap 8 is then hinged toward the holder 7 until it extends more or less parallel to the holder 7 in the horizontal holding position of the candy bar (FIG. 5*b*). For supporting the candy bar in its horizontal holding position the flap 9 extends more or less perpendicular to the holder 7, so that it bears the candy bar (FIG. 5*b*). As the holder 7 holds a plurality of candy bars, each candy bar is supported by an adjacent (underlying) candy bar as well, except for the lowest (underlying) candy bar.

When using said holders 7 the use of both display boxes and transport boxes is avoided, because the holders 7 with the candy bars are suitable for stacking in for instance containers during transport and storage.

The holder 7 serves as a display package of the candy bars in a retail outlet, wherein the holder 7 is hung in a shop with the help of a point of suspension 12.

The invention claimed is:

1. A system comprising at least one package for one or more packaged products, wherein each said at least one package is made of a substantially rectangular foil sheet, a first part of which, near a first cathetus thereof, is adhered to a second part, near a second cathetus positioned opposite said first cathetus, thus forming a tubular envelope comprising a longitudinal seal positioned outside said tubular envelope, which tubular envelope is closed at both ends;

a holder for said at least one package, said holder comprising engaging means for engaging the at least one package in a holding position;

wherein said engaging means in the holding position extend between said tubular envelope and said longitudinal seal.

2. A system according to claim 1, wherein the engaging means comprise at least one flap extending outwardly relative to the holder.

3. A system according to claim 2, wherein the at least one flap of the engaging means in the holding position extends at least substantially parallel to the holder and wherein the at least one flap of the supporting means in the holding position extends at least substantially perpendicular to the holder.

4. A system according to claim 2, wherein the at least one flap is made of a flexible material.

5. A system according to claim 4, wherein the at least one flap can be hinged about a hinge axis.

6. A system according to claim 2, wherein the at least one flap is made of an elastic material.

7. A system according to claim 2, wherein the at least one flap is in one piece with the holder.

8. A system according to claim 1, wherein the holder comprises supporting means for supporting said tubular envelope in the holding position and wherein the supporting means comprise at least one flap extending outwardly relative to the holder.

9. A system according to claim 1, wherein the holder is made of cardboard.

10. The system according to claim 1, wherein the holder is made of paper.

11. The system according to claim 1, wherein the holder is a flat synthetic material.

12. A method for holding together for at least one of transport, storage and displaying at a retail outlet at least one package for one or more packaged products, each said at least one package being made of a substantially rectangular foil sheet, a first part of which, near a first cathetus thereof, is adhered to a second part, near a second cathetus positioned opposite said first cathetus, thus forming a tubular envelope comprising a longitudinal seal positioned outside said tubular envelope, which tubular envelope is closed at both ends;

using a holder for said package, said holder comprising engaging means for engaging the at least one package in a holding position;

wherein the at least one package is engaged in the holding position by said engaging means extending between said tubular envelope and said longitudinal seal.

13. A method according to claim 12, wherein the engaging means are formed by at least one flap extending outwardly relative to the holder.

* * * * *

UNITED STATES PATENT AND TRADEMARK OFFICE

CERTIFICATE OF CORRECTION

PATENT NO. : 8,136,665 B2
APPLICATION NO. : 10/545067
DATED : March 20, 2012
INVENTOR(S) : Niels Van Marle et al.

It is certified that error appears in the above-identified patent and that said Letters Patent is hereby corrected as shown below:

COLUMN 1:

Line 15, “invention” should read --invention,--;
Line 37, “labour-intensive.” should read --labor-intensive.--; and
Line 41, “extend” should read --extends--.

COLUMN 2:

Line 2, “invention” should read --invention,--;
Line 7, “invention” should read --invention,--; and
Line 15, “invention” should read --invention,--.

COLUMN 3:

Line 21, “comprising” should read --comprising:--;
Line 34, “extend” should read --extends--; and
Line 37, “comprise” should read --comprises--.

COLUMN 4:

Line 13, “comprise” should read --comprises--;
Line 22, “outlet” should read --outlet:--; and
Line 38, “are” should read --is--.

Signed and Sealed this
Ninth Day of October, 2012

David J. Kappos

David J. Kappos
*Director of the United States Patent and Trademark Office*